US011255528B1

(12) United States Patent
Lu et al.

(10) Patent No.: US 11,255,528 B1
(45) Date of Patent: Feb. 22, 2022

(54) LIGHT TUBE WITH WIRE GUIDE

(71) Applicant: Xiamen PVTECH Co., Ltd., Fujian (CN)

(72) Inventors: Fuxing Lu, Fujian (CN); Sishan Liao, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/333,027

(22) Filed: May 28, 2021

(30) Foreign Application Priority Data

Apr. 12, 2021 (CN) ..... 202110387055.2

(51) Int. Cl.

| | |
|---|---|
| ***F21V 23/00*** | (2015.01) |
| *F21Y 103/00* | (2016.01) |
| *F21K 9/272* | (2016.01) |
| *F21K 9/27* | (2016.01) |
| *H01R 33/94* | (2006.01) |
| *H01R 33/955* | (2006.01) |

(52) U.S. Cl.
CPC ..... *F21V 23/002* (2013.01); *F21V 23/004* (2013.01); *F21K 9/27* (2016.08); *F21K 9/272* (2016.08); *F21Y 2103/00* (2013.01); *H01R 33/942* (2013.01); *H01R 33/955* (2013.01)

(58) Field of Classification Search
CPC ... F21V 23/002; F21V 23/004; H01R 33/942; H01R 33/955
See application file for complete search history.

(56) References Cited

U.S. PATENT DOCUMENTS

| | | | | |
|---|---|---|---|---|
| 6,027,230 | A * | 2/2000 | Huber | F21V 19/008 362/260 |
| 9,671,072 | B1 * | 6/2017 | May | F21K 9/66 |
| 10,551,046 | B1 * | 2/2020 | Tang | F21K 9/272 |
| 2007/0159826 | A1 * | 7/2007 | Donglin | H01R 33/942 362/260 |
| 2010/0270925 | A1 * | 10/2010 | Withers | F21S 2/00 315/51 |
| 2013/0010461 | A1 * | 1/2013 | Wilson | F21V 23/001 362/217.17 |
| 2015/0300585 | A1 * | 10/2015 | Wu | F21K 9/20 362/222 |
| 2019/0086068 | A1 * | 3/2019 | Wang | H01R 31/065 |
| 2020/0191338 | A1 * | 6/2020 | Yamazaki | F21S 8/06 |

* cited by examiner

*Primary Examiner* — Zheng Song
(74) *Attorney, Agent, or Firm* — Winston Hsu

(57) ABSTRACT

A light tube with wire guide includes a hollowed tube body, two caps, a wire guide, and a plurality of wires. The two caps respectively cover two ends of the hollowed tube body. The wire guide is located at an outer side wall of one of the two caps. The wire guide includes a guiding slot communicating with the hollowed tube body. The wires are disposed in the wire guide and extended along the guiding slot. One ends of the wires are located in the hollowed tube body or located in one of the two caps, and the other ends of the wires extend to the guiding slot and are exposed out of the hollowed tube body.

5 Claims, 7 Drawing Sheets

LIGHT TUBE WITH WIRE GUIDE

CROSS REFERENCE TO RELATED APPLICATION

This application claims priority to China Patent Application No. 202110387055.2, files 2021/04/12, said application is included herein by reference in its entirety.

BACKGROUND OF THE INVENTION

1. Field of the Invention

The present invention relates to a light tube, in particular to a light tube with wire guide.

2. Description of the Prior Art

Light apparatuses become essential tools in our daily lives and are widely used in different fields.

The existing light tube has a simple structure and a single function. However, due to various needs in our lives, the light tube cannot be limited to the simple illumination function. Therefore, how to increase the function of the light tube and to simplify the appearance of the light tube is to be considered.

SUMMARY OF THE INVENTION

In view of these issues, in one embodiment, a light tube with wire guide comprises a hollowed tube body, two caps, a wire guide, and a plurality of wires. The two caps respectively cover two ends of the hollowed tube body. The wire guide is located at an outer side wall of one of the two caps. The wire guide comprises a guiding slot communicating with the hollowed tube body. The wires are disposed in the wire guide and extended along the guiding slot, one ends of the wires are located in the hollowed tube body or located in one of the two caps, and the other ends of the wires extend to the guiding slot and are exposed out of the hollowed tube body.

In one or some preferable implementations of the light tube with wire guide, the light tube with wire guide further comprises a power module. At least a portion of the power module is located in the hollowed tube body, and the one ends of the wires are electrically connected to the circuit board.

In one or some preferable implementations of the light tube with wire guide, the power module comprises a circuit board, and the one ends of the wires are electrically connected to the circuit board.

In one or some preferable implementations of the light tube with wire guide, the light tube with wire guide further comprises a light strip. The light strip comprises a plurality of light-emitting elements, the light strip is electrically connected to the power module, and the wires are dimming wires.

In one or some preferable implementations of the light tube with wire guide, the light tube with wire guide further comprises a connection module. The connection module comprises a first connection member and a second connection member. The wires are electrically connected to the power module through the connection module, and the first connection member and the second connection member are connected to each other and located in the wire guide.

In one or some preferable implementations of the light tube with wire guide, the power module comprises a circuit board, and the first connection member is electrically connected to the circuit board.

In one or some preferable implementations of the light tube with wire guide, the wire guide further comprises a hole. The first connection member comprises a pressing portion protruding from the hole. When a pressing force is applied to the pressing portion, the first connection member is detached from the second connection member.

In one or some preferable implementations of the light tube with wire guide, the light tube with wire guide further comprises a light strip. The light strip comprises a plurality of light-emitting elements, the light strip is electrically connected to the power module, and the wires are dimming wires.

Based on the above, in the light tube with wire guide according to one or some embodiments, because the side wall of the cap has the wire guide, the wires is placed in the wire guide to implement additional functions of the light tube, for example, for light adjustment or for emergency use. Moreover, the light tube has a simplified structure and thus is manufactured easily and with reduced costs. Hence, the issues of existing devices is improved.

These and other objectives of the present invention will no doubt become obvious to those of ordinary skill in the art after reading the following detailed description of the preferred embodiment that is illustrated in the various figures and drawings.

DETAILED DESCRIPTION

The detailed description of the technical content, structural features, and the objects and effects of the technical solutions will be described in detail below with reference to the specific embodiments and the accompanying drawings.

Figure 1:
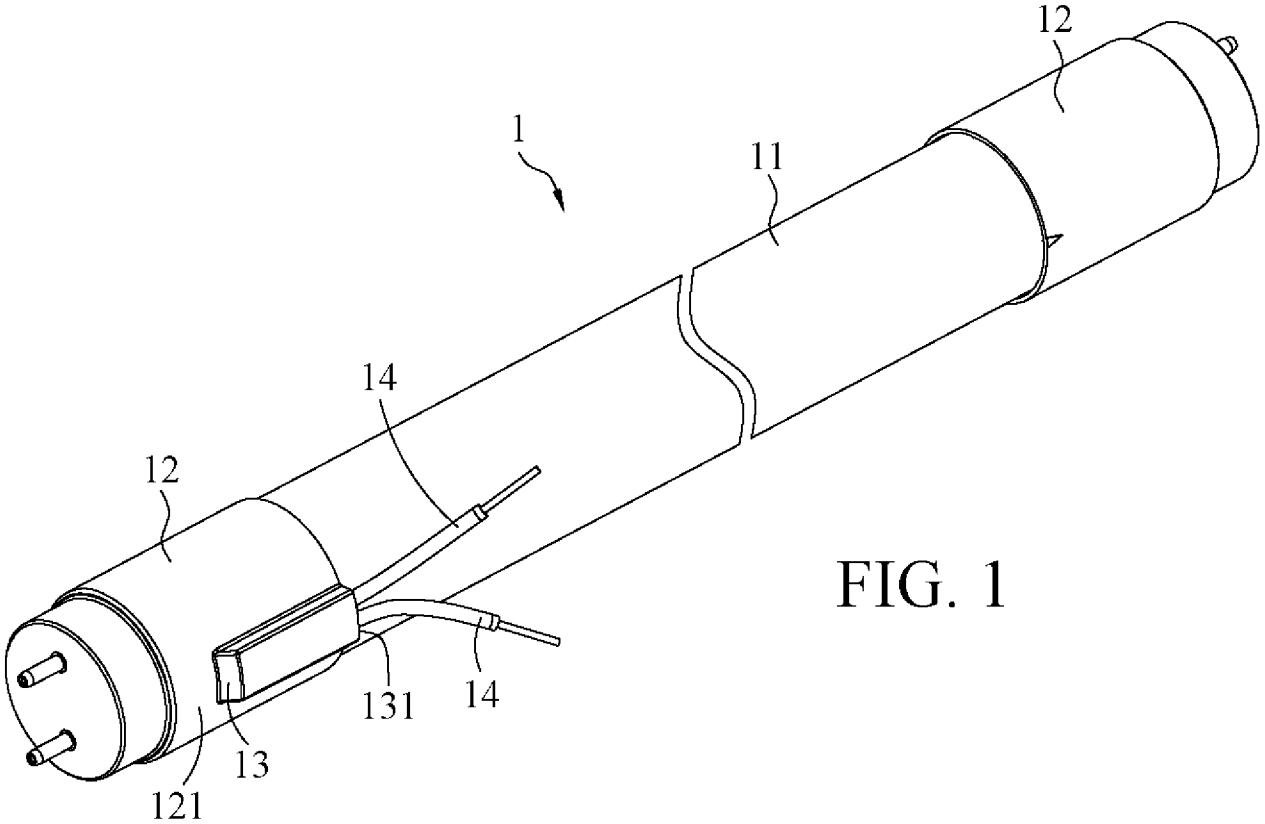
FIG. 1 illustrates a perspective view of a light tube with wire guide according to a first embodiment of the present invention.
Figure 2:
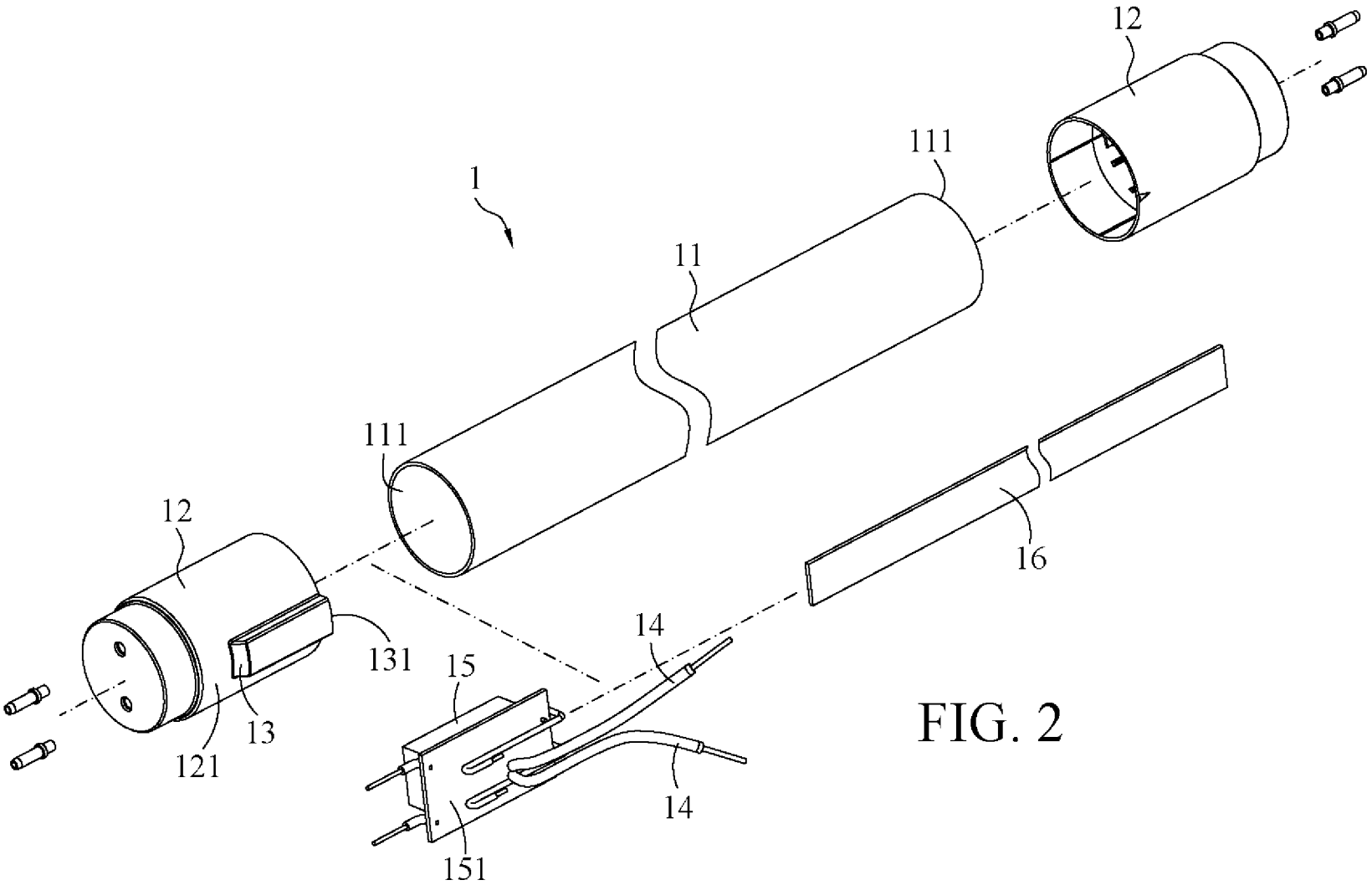
FIG. 2 illustrates an exploded view of the light tube of the first embodiment.
Figure 3:
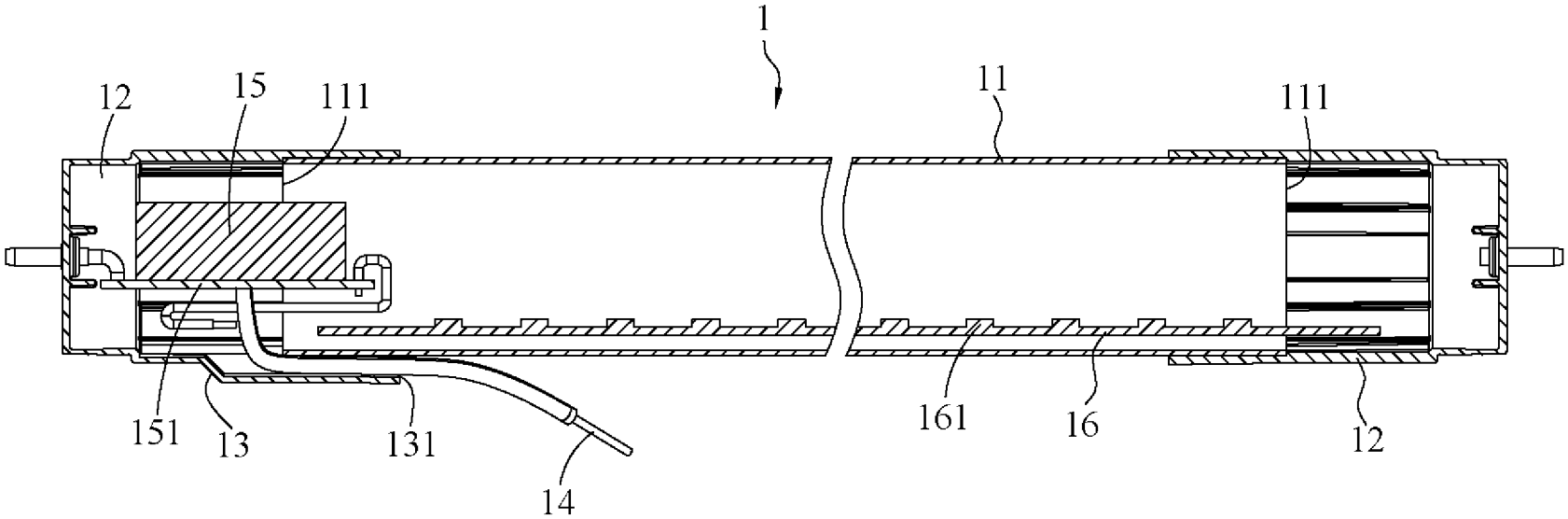
FIG. 3 illustrates a cross-sectional view of the light tube of the embodiment shown in FIG. 1.

Please refer to FIGS. 1 to 4. FIG. 1 illustrates a perspective view of a light tube with wire guide according to a first embodiment of the present invention. FIG. 2 illustrates an exploded view of the light tube of the first embodiment. FIG. 3 illustrates a cross-sectional view of the light tube of the embodiment shown in FIG. 1.

The light tube with wire guide (the light tube 1) comprises a hollowed tube body 11, two caps 12, a wire guide 13, and a plurality of wires 14. The two caps 12 respectively cover two ends of the hollowed tube body 11. The wire guide 13 is located at an outer side wall 121 of one of the two caps 12. The wire guide 13 comprises a guiding slot 131 communicating with the hollowed tube body 11. The wires 14 are disposed in the wire guide 13 and extended along the guiding slot 131. One ends of the wires 14 are located in the hollowed tube body 11 or located in one of the two caps 12. The other ends of the wires 14 extend to the guiding slot 131 and are exposed out of the hollowed tube body 11.

In this embodiment, with the wire guide 13, wires 14 is placed in the light tube 1 to increase the function of the light tube 1, and the wires 14 is organized easily, and the light tube 1 is used conveniently.

As shown in FIGS. 2 and 3, in this embodiment, the light tube 1 further comprises a power module 15. At least a portion of the power module 15 is located in the hollowed tube body 11. The one ends of the wires 14 are electrically connected to the power module 15. In this embodiment, the power module 15 comprises a circuit board 151, and the one ends of the wires 14 are electrically connected to the circuit board 151.

Moreover, in this embodiment, the light tube 1 further comprises a light strip 16. The light strip 16 comprises a plurality of light-emitting elements 161. As shown in FIG. 3, the light strip 16 is electrically connected to the power module 15. In this embodiment, the wires 14 are dimming wires, but embodiments are not limited thereto. In some embodiments, the wires 14 may be served as an emergency element; namely, in this embodiment, the light tube 1 is a light tube for emergency use.

Figure 4:
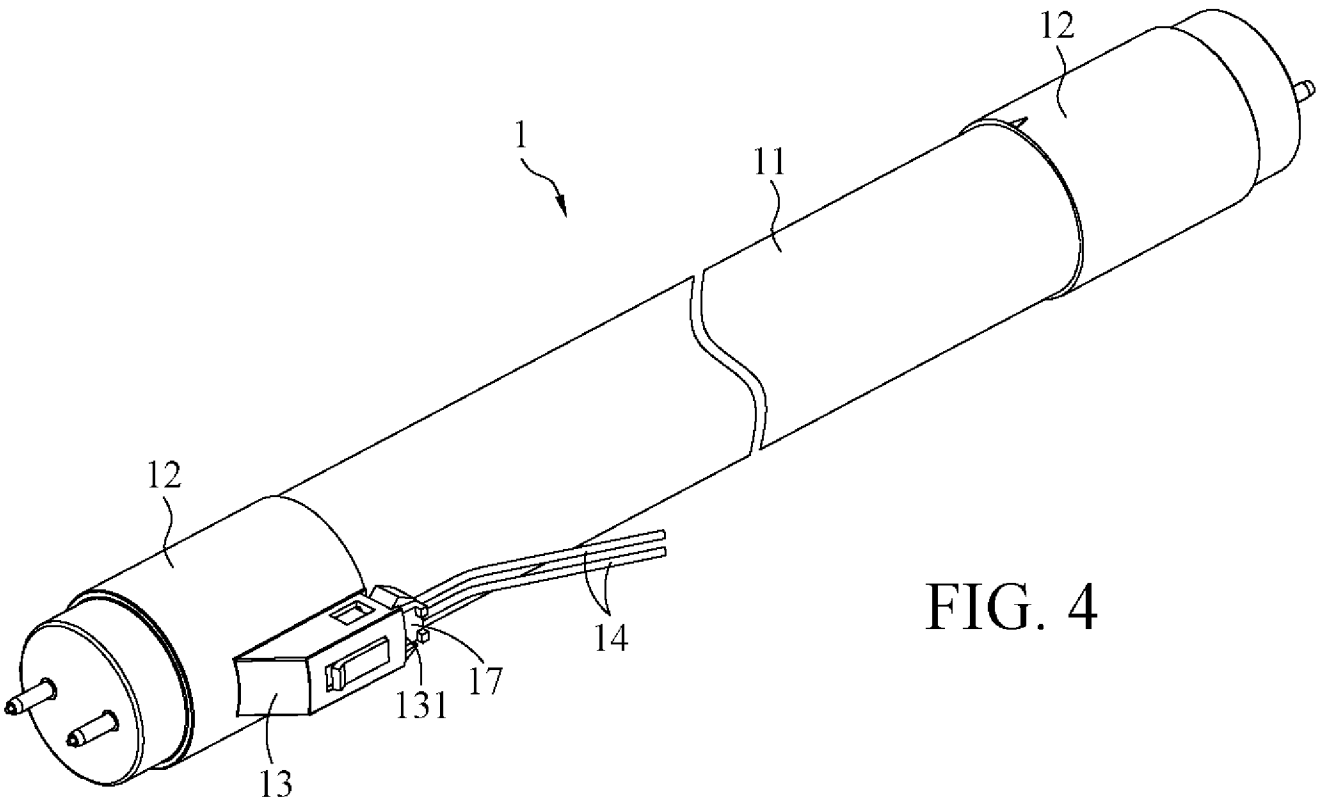
FIG. 4 illustrates a perspective view of a light tube with wire guide according to a second embodiment of the present invention.
Figure 5:
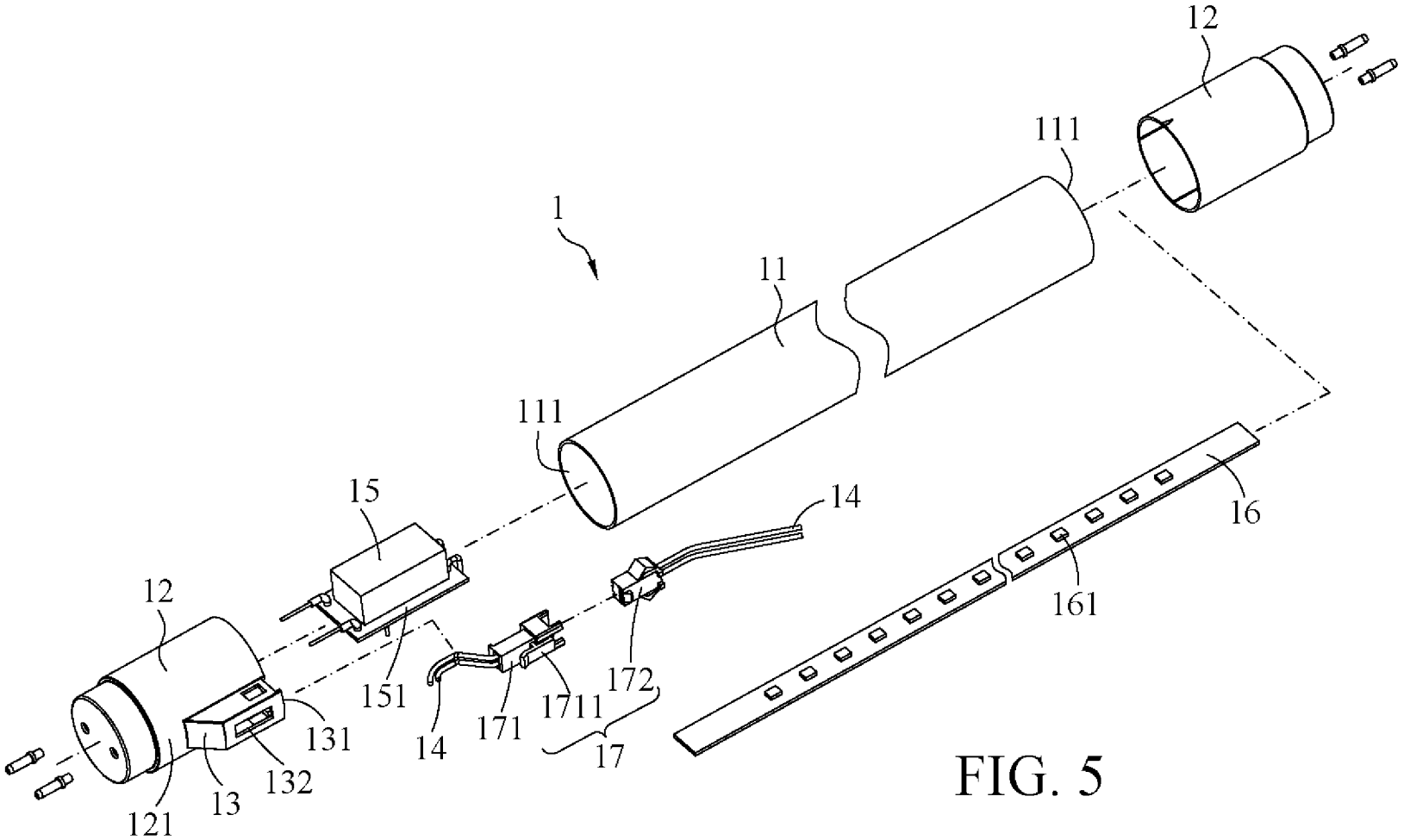
FIG. 5 illustrates an exploded view of the light tube of the second embodiment.
Figure 6:
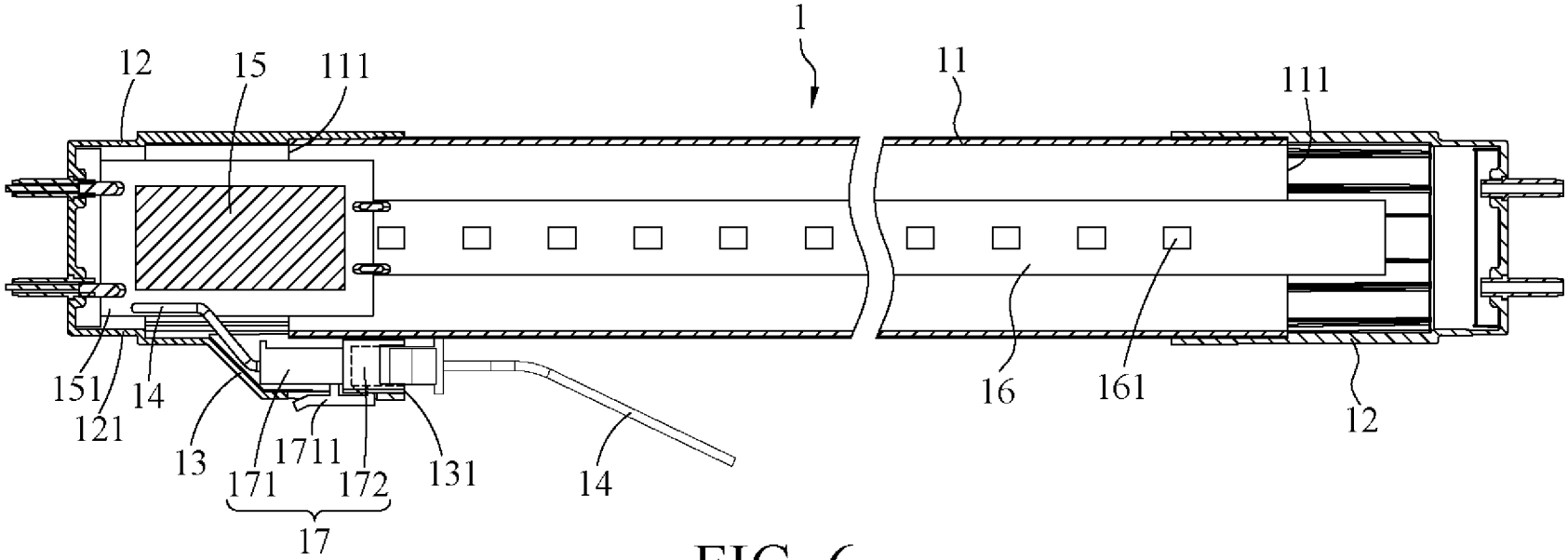
FIG. 6 illustrates a cross-sectional view of the light tube of the embodiment shown in FIG. 4.
Figure 7:
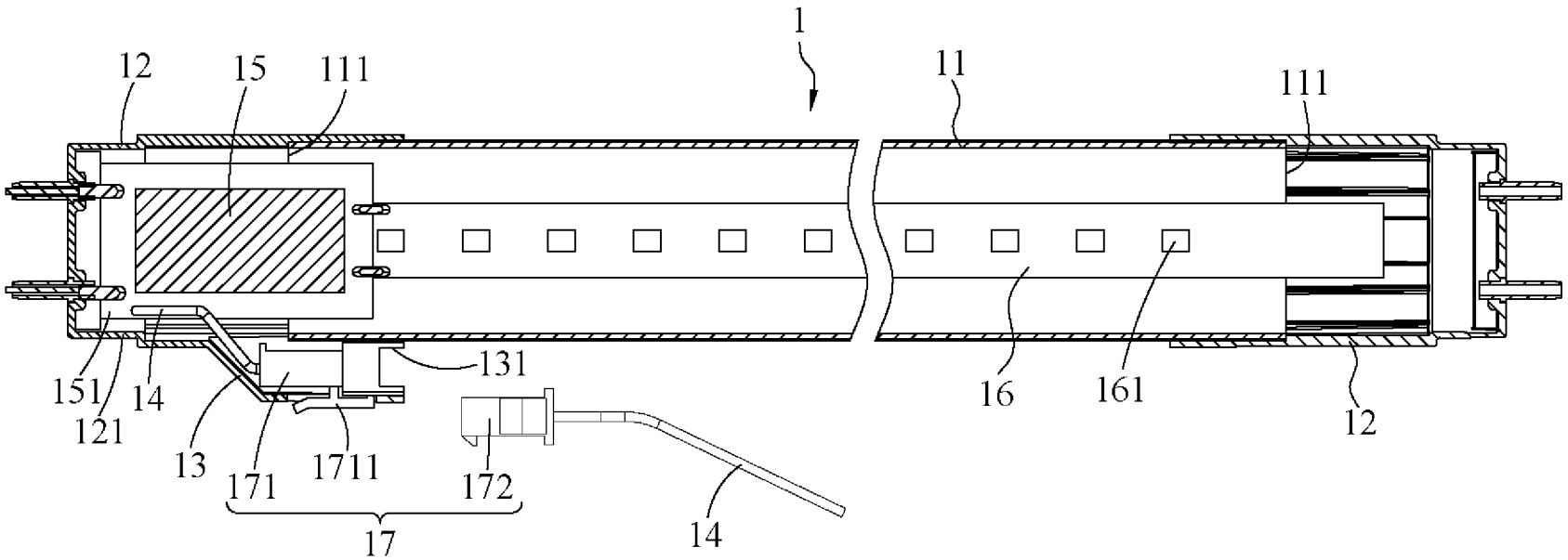
FIG. 7 illustrates a cross-sectional view of the light tube of the embodiment shown in FIG. 4.

Please refer to FIGS. 4 to 6. FIG. 4 illustrates a perspective view of a light tube with wire guide according to a second embodiment of the present invention. FIG. 5 illustrates an exploded view of the light tube of the second embodiment. FIG. 6 illustrates a cross-sectional view of the light tube of the embodiment shown in FIG. 4. FIG. 7 illustrates a cross-sectional view of the light tube of the embodiment shown in FIG. 4. FIG. 6 and FIG. 7 illustrate schematic views for different operating conditions.

The differences between the second embodiment and the first embodiment are the structure of the wire guide 13 and the configuration of the wires 14. In the second embodiment, the light tube 1 further comprises a connection module 17, and the connection module 17 comprises a first connection member 171 and a second connection member 172. The wires 14 are electrically connected to the power module 15 through the connection module 17. The first connection member 171 and the second connection member 172 are connected to each other and located in the wire guide 13 (as shown in FIGS. 4 and 6). The first connection member 171 may be a male connector or a female connector, and the second connection member 172 is a connector mating with the first connection member 171, and embodiments are not limited thereto. The wire guide 13 further comprises a hole 132. The first connection member 171 comprises a pressing portion 1711 protruding from the hole 132. When the pressing portion 1711 is applied with a pressing force, the first connection member 171 is detached from the second connection member 172 (as shown in FIG. 7). In other words, with such configuration, the wiring procedure of the light tube 1 is implemented easily, and the light tube 1 can have a beautiful appearance. In this embodiment, the power module 15 comprises a circuit board 151, and the first connection member 171 is electrically connected to the circuit board 151.

Similar to the first embodiment, in the second embodiment, the light tube 1 may further comprise a light strip 16, and the light strip 16 comprises a plurality of light-emitting elements 16. The light strip 16 is electrically connected to the power module 15, and the wires 14 are dimming wires, but embodiments are not limited thereto. In some embodiments, the wires 14 may be served for other purposes. As mentioned above, the wires 14 may be served as an emergency component.

As above, in the light tube with wire guide according to one or some embodiments, because the side wall of the cap has the wire guide, the wires is placed in the wire guide to implement additional functions of the light tube, for example, for light adjustment or for emergency use. Moreover, the light tube has a simplified structure and thus is manufactured easily and with reduced costs. Hence, the issues of existing devices is improved.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light tube with wire guide, comprising:

a hollowed tube body;

two caps respectively covering two ends of the hollowed tube body;

a wire guide located at an outer side wall of one of the two caps, wherein the wire guide comprises a guiding slot communicating with the hollowed tube body;

a plurality of wires disposed in the wire guide and extended along the guiding slot, wherein one ends of the wires are located in the hollowed tube body or located in one of the two caps, and the other ends of the wires extend to the guiding slot and are exposed out of the hollowed tube body;

a power module, wherein at least a portion of the power module is located in the hollowed tube body, and the one ends of the wires are electrically connected to the power module; and a connection module, wherein the connection module comprises a first connection member and a second connection member, the wires are electrically connected to the power module through the connection module, and the first connection member and the second connection member are connected to each other and located in the wire guide;

wherein the wire guide further comprises a hole, the first connection member comprises a pressing portion protruding from the hole, and wherein when a pressing force is applied to the pressing portion, the first connection member is detached from the second connection member.

2. The light tube with wire guide according to claim 1, wherein the power module comprises a circuit board, and the one ends of the wires are electrically connected to the circuit board.

3. The light tube with wire guide according to claim 1, further comprising a light strip, wherein the light strip comprises a plurality of light-emitting elements, the light strip is electrically connected to the power module, and the wires are light-adjustable wires.

4. The light tube with wire guide according to claim 1, wherein the power module comprises a circuit board, and the first connection member is electrically connected to the circuit board.

5. The light tube with wire guide according to claim 1, further comprising a light strip, wherein the light strip comprises a plurality of light-emitting elements, the light strip is electrically connected to the power module, and the wires are light-adjustable wires.

* * * * *